US008286386B2

(12) United States Patent
Shatley

(10) Patent No.: US 8,286,386 B2
(45) Date of Patent: Oct. 16, 2012

(54) CHRISTMAS TREE STAND AND METHOD AND APPARATUS FOR ATTACHING A CHRISTMAS TREE TO A CHRISTMAS TREE STAND AND A DRILL BIT

(76) Inventor: Daniel Paul Shatley, West Jefferson, NC (US)

( * ) Notice: Subject to any disclaimer, the term of this patent is extended or adjusted under 35 U.S.C. 154(b) by 729 days.

(21) Appl. No.: 12/319,572

(22) Filed: Jan. 9, 2009

(65) Prior Publication Data

US 2009/0193714 A1 Aug. 6, 2009

Related U.S. Application Data

(60) Provisional application No. 61/063,252, filed on Jan. 31, 2008.

(51) Int. Cl.
*A47G 33/12* (2006.01)

(52) U.S. Cl. ..... 47/40.5

(58) Field of Classification Search ..... 47/39, 40.5, 47/41.12, 42, 43; *A47G 07/02, 33/12*
See application file for complete search history.

(56) References Cited

U.S. PATENT DOCUMENTS

| | | | | |
|---|---|---|---|---|
| 1,411,722 | A | 4/1922 | Grenzebach | |
| 2,111,642 | A * | 3/1938 | Saier | 431/297 |
| 2,337,914 | A | 12/1943 | Meldrum | |
| 2,537,826 | A | 1/1951 | Hauser | |
| 2,609,169 | A | 9/1952 | Kroeger | |
| 2,746,700 | A * | 5/1956 | Barbera | 47/40.5 |
| 2,891,747 | A | 6/1959 | Steede | |
| 2,997,264 | A * | 8/1961 | Zelenitz | 248/516 |
| 4,130,965 | A | 12/1978 | Patton et al. | |
| 4,585,201 | A * | 4/1986 | Pursell | 248/523 |
| 4,610,356 | A * | 9/1986 | Porter et al. | 206/423 |
| 4,762,454 | A * | 8/1988 | Davis | 411/446 |
| 2009/0119983 | A1 * | 5/2009 | Jones | 47/40.5 |

OTHER PUBLICATIONS

Tim Mitchell's Yule Stand System; internet website; Jan. 9, 2009.

* cited by examiner

*Primary Examiner* — Son T Nguyen
*Assistant Examiner* — Thien Thanh Pham
(74) *Attorney, Agent, or Firm* — Carter & Schnedler, P.A.

(57) ABSTRACT

A Christmas tree stand, a method for affixing a Christmas tree to a Christmas tree stand, and a drill bit for forming a groove in the bottom of a Christmas tree are provided. The Christmas tree stand includes a base having a male member extending upwardly therefrom with at least a portion of the male member received in the groove in the bottom of the Christmas tree. Preferably an insert in the form of a cylinder is received within the groove. Upon the receipt of the male member in the groove, the Christmas tree is stabilized on the base.

4 Claims, 9 Drawing Sheets

CHRISTMAS TREE STAND AND METHOD AND APPARATUS FOR ATTACHING A CHRISTMAS TREE TO A CHRISTMAS TREE STAND AND A DRILL BIT

RELATIONSHIP TO PRIOR APPLICATION

This is a U.S. non-provisional application relating to and claiming the benefit of U.S. Provisional Patent Application Ser. No. 61/063,252, filed Jan. 31, 2008.

BACKGROUND OF THE INVENTION

This invention relates to Christmas tree stands and methods and apparatus for attaching Christmas trees to Christmas tree stands. There are many designs of Christmas tree stands currently on the market. Many Christmas tree stands include a basin which is adapted to be partially filled with water. The basin receives the lower portion of the trunk of the Christmas tree. Various devices have been provided to hold the Christmas tree in an upright position in the Christmas tree stand, such as elongated screws mounted in the stand which make contact with the trunk of the Christmas tree around its periphery. It is often difficult for the consumer to make adjustments to these holding devices, such as the aforementioned elongated screws, so as to hold the Christmas tree substantially vertical.

SUMMARY OF THE INVENTION

In accordance with one form of this invention there is provided a Christmas tree stand assembly including a base for supporting a Christmas tree having a trunk which has a preformed groove in the bottom of the trunk. The base has an inside surface adapted to face the Christmas tree. A male member extends upwardly from the inside surface of the base. At least a portion of the male member is adapted to be received in the groove formed in the bottom of the trunk of the Christmas tree so that the Christmas tree may be substantially stabilized on the base. Preferably, the male member is a hollow form and is cylindrical in shape. Also preferably, an insert is provided to be received in the groove in the bottom of the trunk of the Christmas tree. Preferably, the insert is in the form of a single cylinder or the combination of a small diameter cylinder received within a larger diameter cylinder with the single cylinder or the small diameter cylinder receiving the male member.

In accordance with another form of this invention there is provided the combination of a Christmas tree and a Christmas tree stand. The Christmas tree has a trunk with a bottom. A groove is formed in the bottom of the trunk. A base is provided for supporting the Christmas tree. The base has an inside surface facing the Christmas tree. A male member extends upwardly from the inside surface of the base. At least a portion of the male member is received in the groove formed in the bottom of the trunk of the Christmas tree so that the Christmas tree may be substantially stabilized on the base.

In accordance with another form of this invention there is provided a method for affixing a Christmas tree to a Christmas tree stand having a base for supporting the Christmas tree which has a trunk. The base has an inside surface adapted to face the Christmas tree. A male member extends upwardly from the inside surface of the base. The method includes forming a groove in the bottom of the trunk of the Christmas tree and inserting at least a portion of the male member into the groove.

In accordance with yet another form of this invention there is provided a drill bit, including a drill body and a drive rod. The drill body has first and second ends. The first end of the drill body is connected to the drive rod. The drill body has a set of teeth projecting away from the second end. A set of tines projectis outwardly from the drill body.

BRIEF DESCRIPTION OF THE DRAWINGS

The subject matter which is regarded as the invention is set forth in the appended claims. The invention itself, however, together with further objects and advantages thereof may be better understood in reference to the following description taken in conjunction with the accompanying drawings.

DESCRIPTION OF THE PREFERRED EMBODIMENTS

Figure 1:
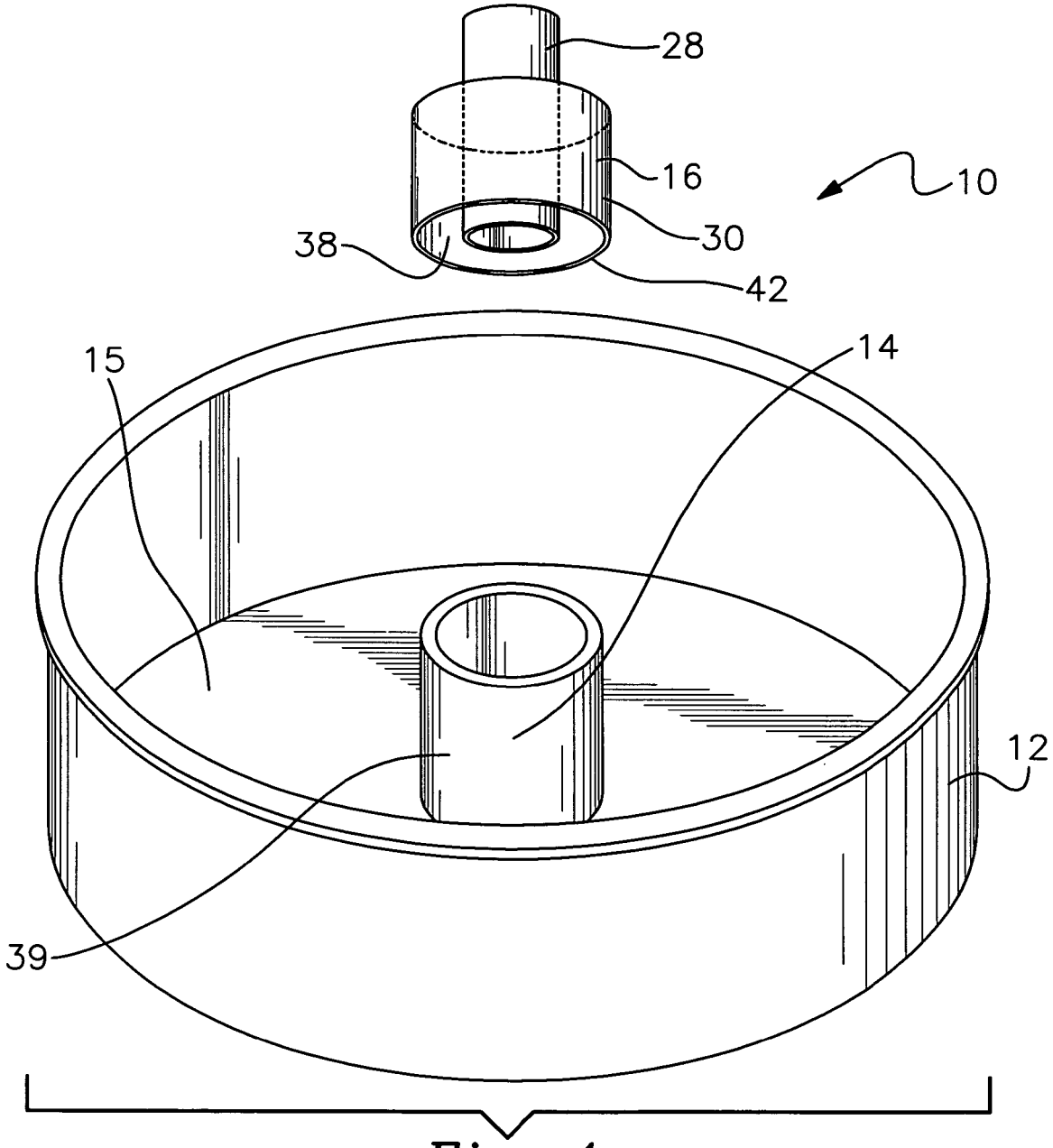
FIG. 1 is an exploded pictorial view of Christmas tree stand base and adaptor in accordance with one embodiment of the invention.
Figure 2:
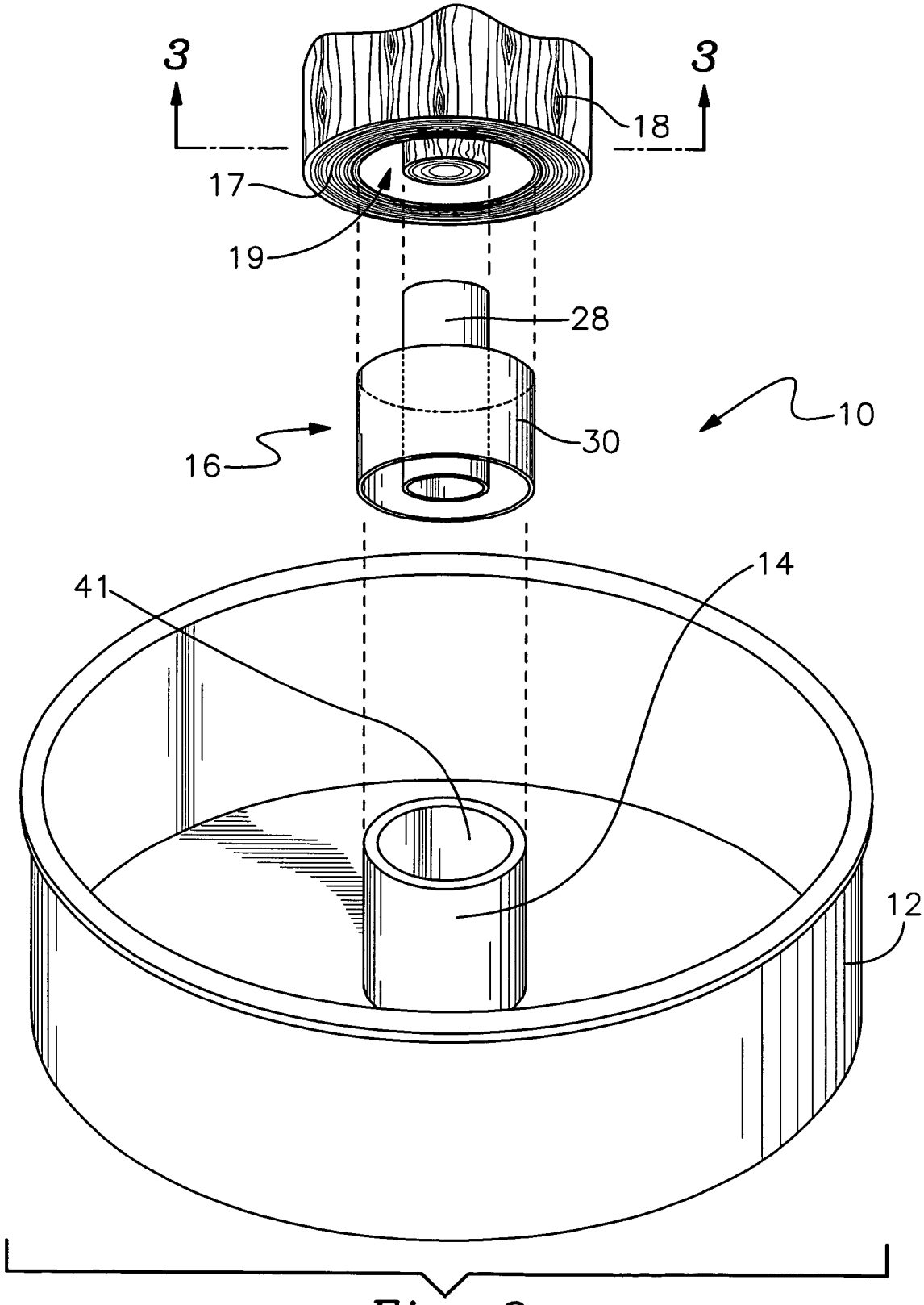
FIG. 2 is an exploded pictorial view of the adaptor and basin of FIG. 1 as well as a trunk of a Christmas tree which has been drilled out in accordance with one embodiment of the invention.

Referring now to FIGS. 1 and 2, there is provided a Christmas tree stand assembly 10, including base 12 which in this embodiment is in the form of a basin which is adapted to receive water. Male member 14, which in this embodiment is a hollow upright tube, is attached to the bottom or inside surface 15 of the basin which is adapted to face the Christmas tree. Adaptor 16 is removably received over hollow tube 14. Adaptor 16 is placed in groove 19 in the bottom 17 of the trunk of the tree 18 after the tree has been cut and groove 19 has been formed in the bottom 17. Groove 19 is ring shaped and includes at least two spaced apart curved walls in the bottom 17 of the trunk of the tree 18 leaving a central portion of the trunk which is defined by one of the curved walls.

Figure 3:
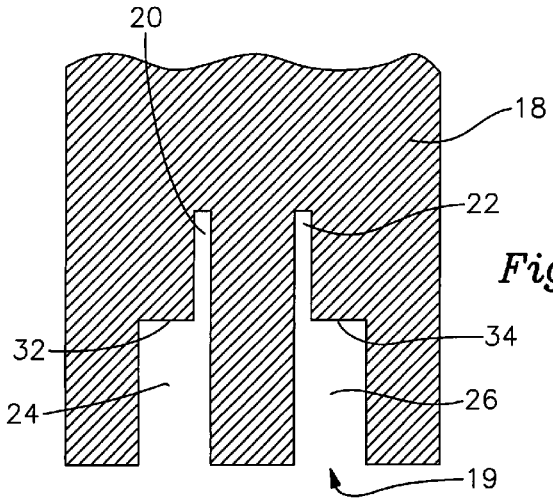
FIG. 3 is a cross-sectional view of the trunk of the Christmas tree of FIG. 2 taken through section line 3-3.

In order to place adaptor 16 into the bottom 17 of the trunk of tree 18, the bottom of the trunk of tree 18 must be drilled out to form groove 19 which, in this embodiment as shown in FIG. 3, are carved cavities or slots described below. FIG. 3 shows a cross-section of the trunk of the tree after it has been drilled out.

Figure 5:
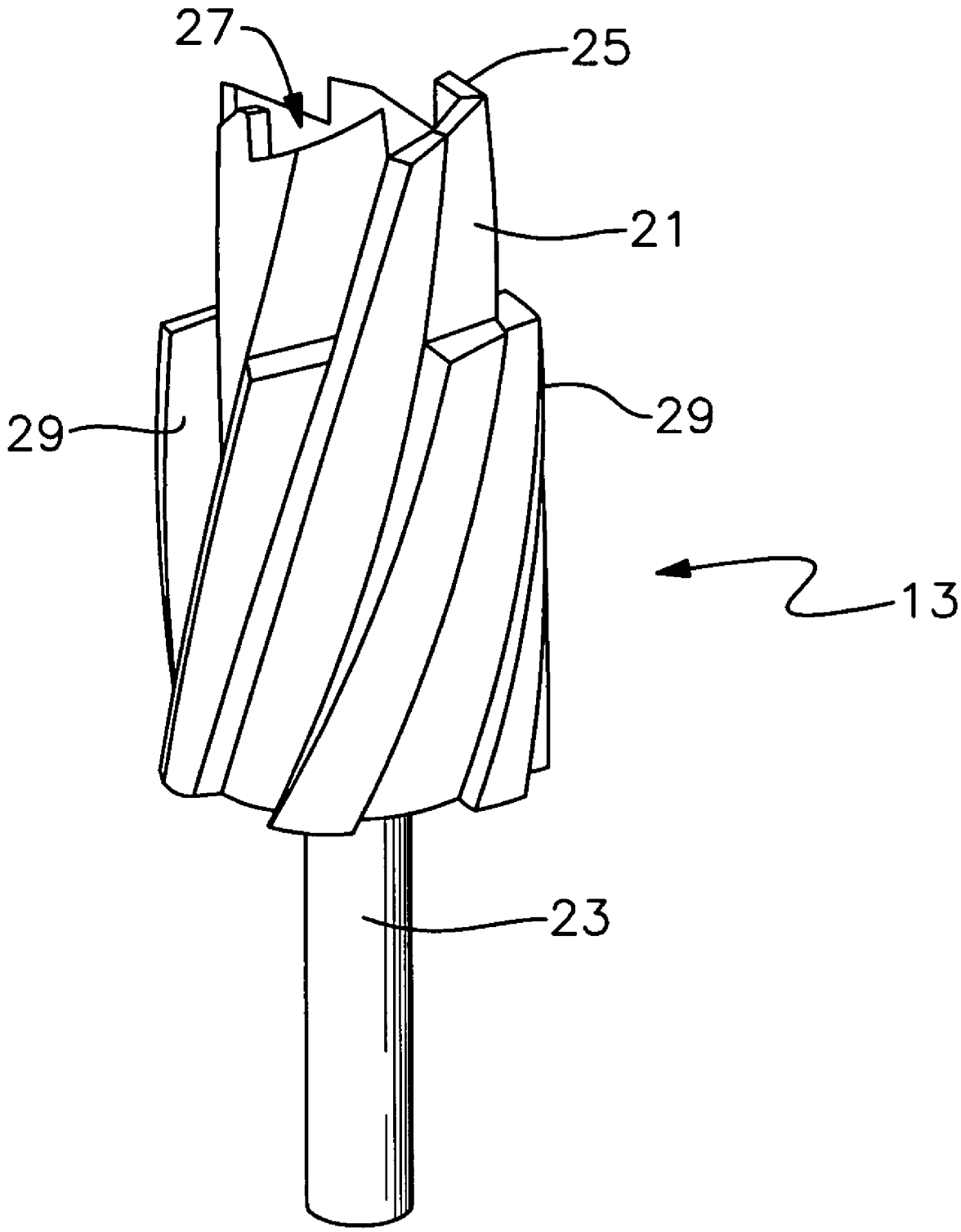
FIG. 5 is a pictorial view of a drill bit which may be used to form the drilled out portion shown in FIG. 4.

In order to form the cavities shown in FIG. 3 in the trunk of the tree, a specially constructed drill bit, such as drill bit 13 shown in FIG. 5, may be used. Drill bit 13 includes drill body 21 having a first end attached to drive rod 23. Drill body 21 includes a set of teeth 25 extending or projecting away from the second end or front thereof. The center 27 of drill bit 13 is hollow so that when that portion of the drill bit cuts the wood, it only removes a ring in the bottom of the tree. The set of teeth 25 of drill bit 13 are used to form a narrow deep ring, which appears as narrow slots 20 and 22 in FIG. 3 because of the cross-section, in the bottom 17 of the trunk of the Christmas tree.

Drill bit 13 also includes a set of outer cutting tines 29 which are attached to and project outwardly from drill body 21. The set of tines 29 are used to form a wide shallow ring, which appears as wide slots 24 and 26 in FIG. 3 because of the cross-section, in the trunk of the Christmas tree. Thus, tines 29 effectively form a counter-bore. Tines 29 include leading edges and trailing edges. The leading edges are located a predetermined distance from the set of teeth 25. The cross-sections of the set of teeth and the set of tines form circles. The diameter of the circle formed by the set of teeth is smaller than the diameter of the circle formed by the set of tines.

Figure 4:
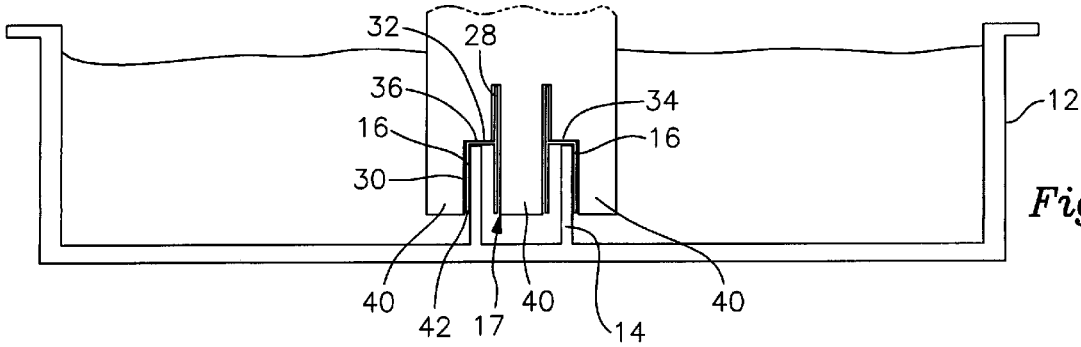
FIG. 4 is a sectional view showing the adaptor inserted into the drilled out portion of the trunk of the Christmas tree and with the adaptor received on the upright tube attached to the bottom of the base.

Using drill bit 13, both the deep ring cut, i.e., slots 20/22 and shallow counter-bore 24/26 are formed in the same operation. The bit may also be fluted to help remove wood chips. When discussing slots 20 and 22 and slots 24 and 26 below, it should be noted that those slots are actually ring-shaped as shown in FIG. 2 as generally shown as groove 19. The ring-shaped grooves appear as slots in cross-section as shown in FIGS. 3 and 4.

As can be seen in FIG. 3, narrow slots 20 and 22 are drilled deeper into the trunk of the tree than wide slots 24 and 26.

Figure 6:
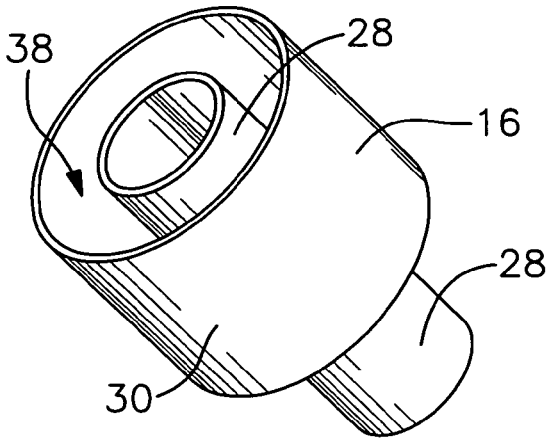
FIG. 6 is a pictorial view of an adaptor in accordance with one embodiment of the invention.
Figure 7:
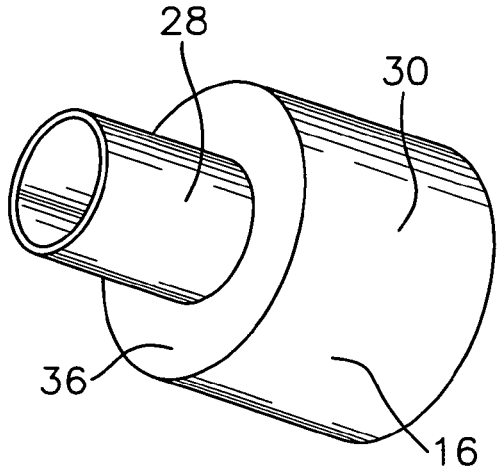
FIG. 7 is another pictorial view of an adaptor of FIG. 6.
Figure 8:
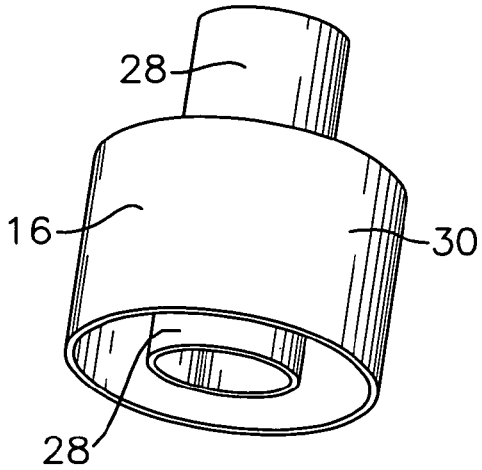
FIG. 8 is yet another pictorial view of an adaptor of FIG. 6.

Adaptor 16, as shown in FIGS. 6 through 8, preferably includes small hollow tube 28 and large hollow tube 30. Small hollow tube 28 passes through the center of large hollow tube 30 and is attached to large hollow tube 30 by circular web 36. The walls of the upper portion of small hollow tube 28 of adaptor 16 are received in the deeper ring shown as narrow slots 20 and 22 in the trunk of the Christmas tree and the walls of large hollow tube 30 are received in shallower ring shown as wide slots 24 and 26. The web 36 of large hollow tube 30 abuts against the tops 32 and 34 of wide slots 24 and 26.

Figure 13:
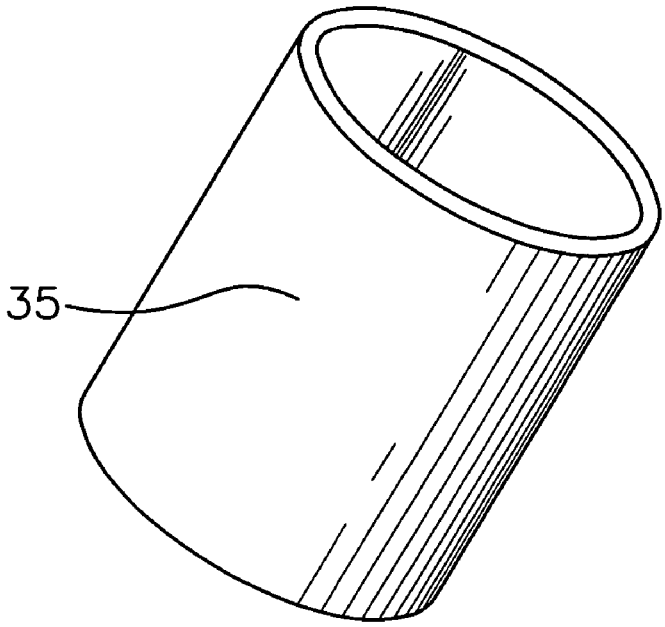
FIG. 13 is a pictorial view of an alternative embodiment of an adaptor.
Figure 14:
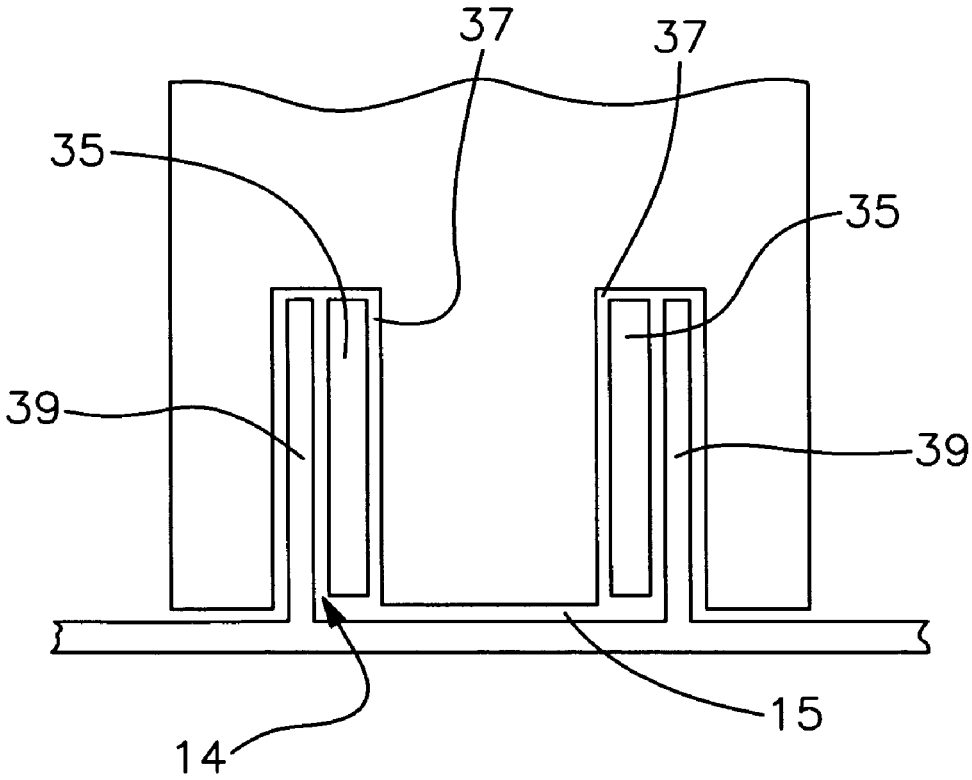
FIG. 14 is a sectional view showing a portion of the trunk of a Christmas tree with the adaptor of FIG. 13 being received in a groove formed in the trunk of the Christmas tree and further showing a portion of a male member which projects upwardly from the base of the Christmas tree stand.

Alternatively, the adaptor could be a single hollow tube such as tube 35 shown in FIG. 13. In that case, either the deep ring cut 20/22 or the shallow counter-bore 24/26 in the trunk of the tree may be eliminated. As can be seen in FIG. 14, when using adaptor 35, a single ring cut 37 is preferably made in the bottom of the trunk of the Christmas tree. The ring cut 37 is wide enough to accommodate both the adaptor 35 and the walls 39 of hollow upright tube 14 which is attached to inside surface 15 of basin 12. To eliminate deep ring cut 20/22, the portion of the drill body 21 which extends above tines 29 shown in FIG. 5 could be removed. To eliminate the counter-bore 24/26, tines 29 of drill bit 19 could be removed. An additional alternative design for the adaptor could be the same as adaptor 16 except that the portion of small hollow tube 28 which extends above web 36 is removed. In that embodiment, deep ring cut 20/22 in the trunk of the tree is not needed and drill bit 19 may be modified accordingly.

Figure 9:
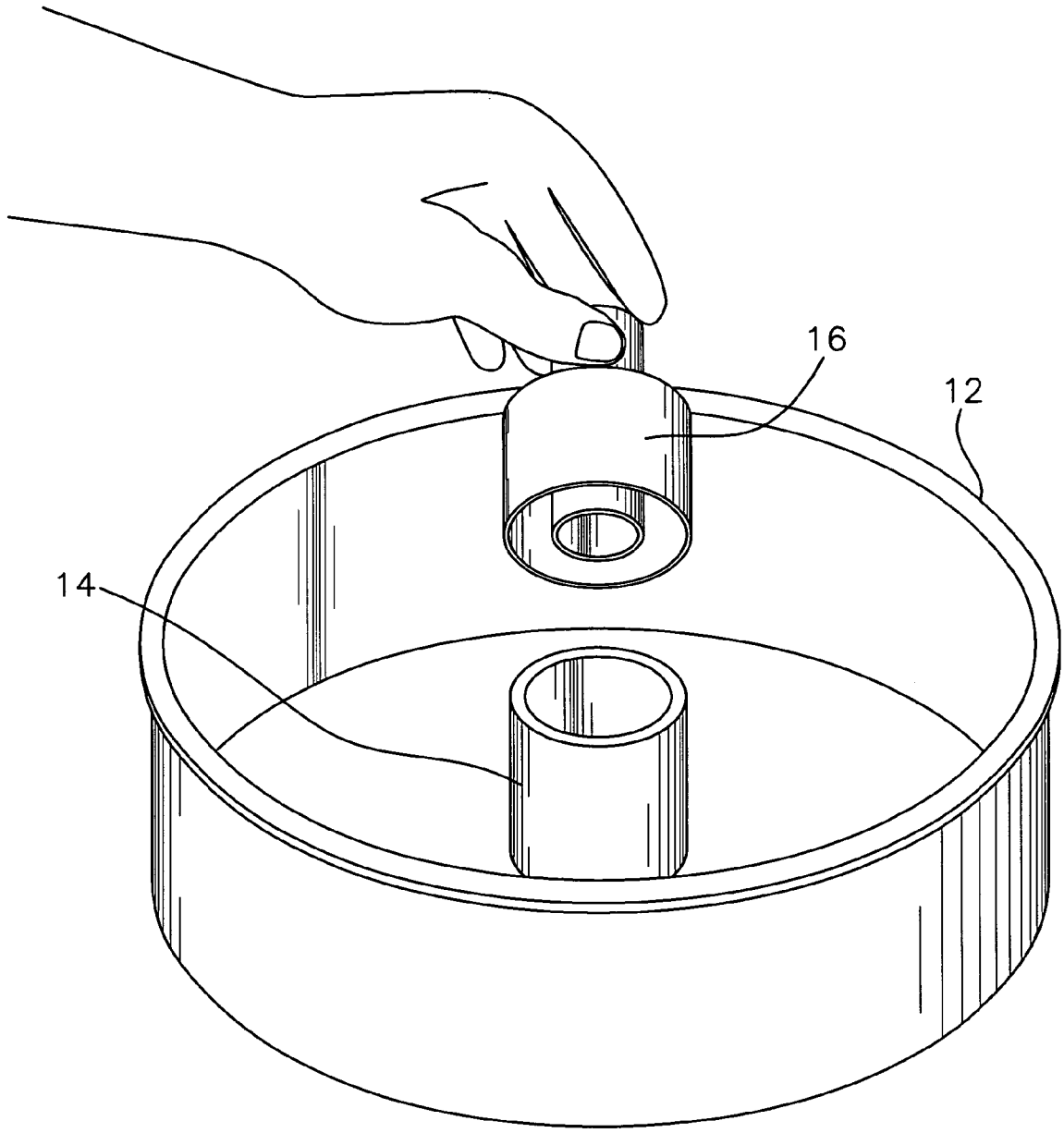
FIG. 9 is a pictorial view of an adaptor being placed on the tube extending upwardly from the base in accordance with one embodiment of the invention.
Figure 10:
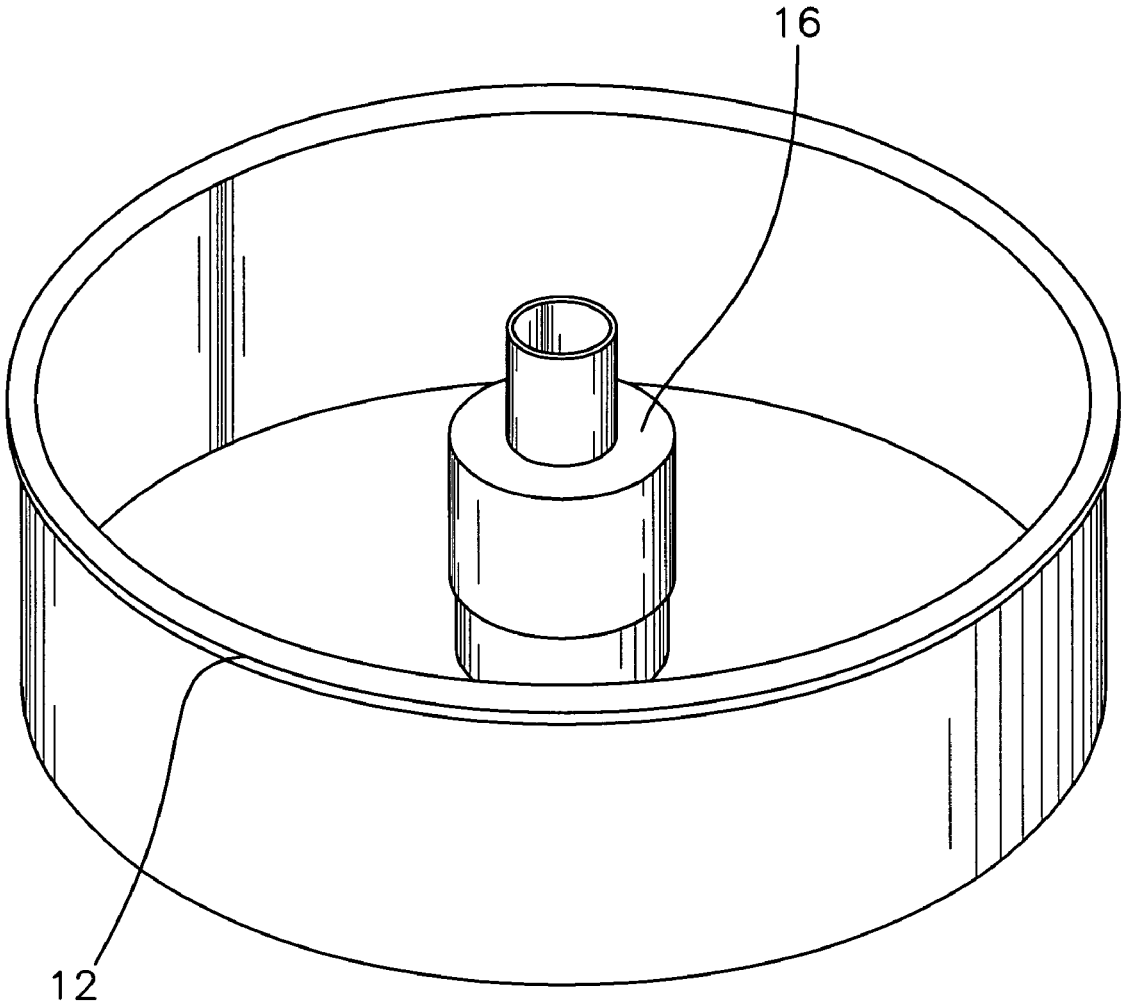
FIG. 10 is a pictorial view of an adaptor received on the tube extending upwardly from the base in accordance with one embodiment of the invention.

Referring again to the embodiment of FIGS. 1-3, adaptor 16 is preferably inserted into the bottom of the trunk of the Christmas tree before the tree is placed in basin 12. This insertion may be done by hand. Thus, FIGS. 9 and 10 which show adaptor 16 being placed and having been placed onto upright tube 14 inside of stand 12 are for illustrative purposes only because, in reality, the adaptor 16 should be inserted into groove 19 in the bottom 17 of Christmas tree 18 before the adaptor 16 and the upright tube are intermated. The walls 39 of tube 14, which extend upwardly from the inside of the bottom or inside surface 15 of the basin 12, are received in space 38 which is formed between large hollow tube 30 and small hollow tube 28. Small hollow tube 28 is received in opening 41 of upright hollow tube 14. Thus, one end of adaptor 16 is firmly received in the inside of trunk of Christmas tree 18 while the other end of adaptor 16 is firmly mounted on upright hollow tube 14 within basin 12. The Christmas tree therefore has been secured to the Christmas tree stand and may be situated in a vertical position without the need to make adjustments to elongated screws or other mounting devices. In addition, since the tree trunk is preferably predrilled shortly after cutting the tree and the adaptor 16 is inserted into the predrilled cavities of the trunk of the tree, the consumer need only align the adaptor 16 with upright tube 14 and place the tree in the stand.

Preferably, as shown in FIG. 4, adaptor 16 is pressed deeply enough into the trunk of the tree so that portion 40 of the bottom 17 of the tree extends below the lower lip 42 of tube 40. This arrangement enables one to make a fresh cut on the bottom of the tree after the adaptor is installed in the bottom of the tree but before the tree is placed in basin 12. The fresh cut enables water 45, as shown in FIG. 12, to more readily be absorbed by the tree.

Figure 11:
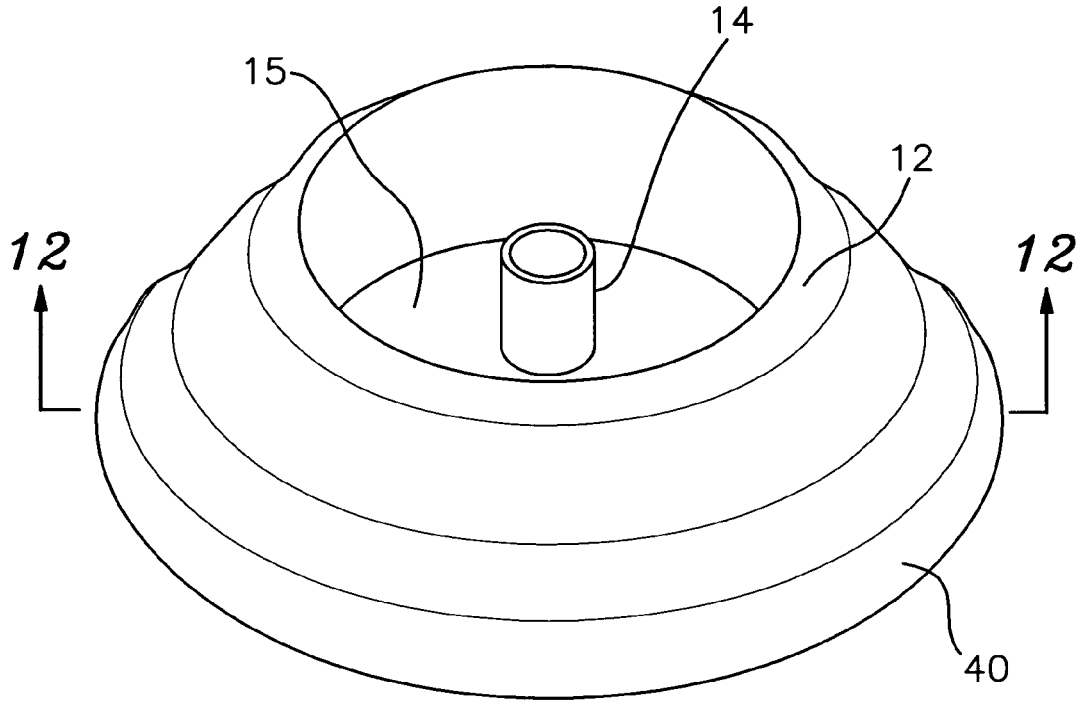
FIG. 11 is a pictorial view of a Christmas tree stand base in accordance with another embodiment of the invention.
Figure 12:
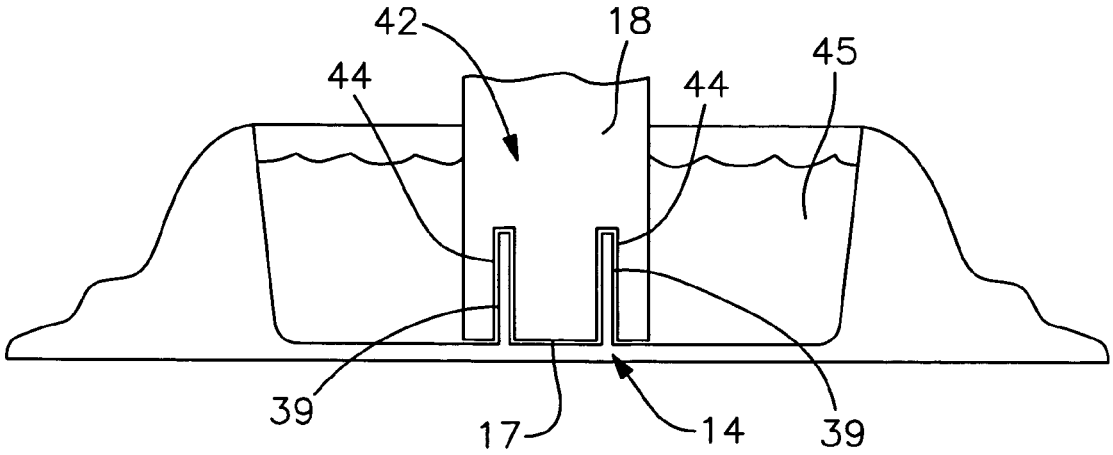
FIG. 12 is a cross-sectional view of the Christmas tree stand base of FIG. 11 showing a portion of a trunk of a Christmas tree received on the base taken through section line 12-12.

While an adaptor increases the structural integrity of the connection of the base 12 to the tree, in another embodiment of the invention as illustrated in FIGS. 11 and 12, an adaptor, such as adaptors 16 and 35, are eliminated entirely. As shown in FIG. 11, basin 12 is attached to or made integral with stabilizing base 40. A male member, such as hollow upright tube 14, is attached to and extends upwardly from inside surface 15 which forms the bottom of basin 12. The hollow upright tube 14 is a cylinder having a curved wall 39 and first and second ends. The curved wall of the cylinder includes an inner surface and an outer surface. The first end is attached to surface 15 of basin 12 and the second end is open. Thus, basin 12 in FIG. 11 may be substantially identical to basin 12 shown in FIGS. 1 and 2. As shown in FIG. 12, the trunk of Christmas tree 18 includes groove 44 which is a much simpler groove than groove 19 shown in FIGS. 2 and 3 in that a single ring shaped groove 44 is cut in the bottom 17 of the trunk of tree 18 forming two spaced apart curved walls. The ring shaped groove 44 in FIG. 12 is similar to the ring shaped groove 37 shown in FIG. 14 except it is preferably more narrow so as to tightly accommodate wall 39 of male member or hollow cylindrical upright tube 14. The curved wall 39 of the upright tube or cylinder 14 is located between the curved walls of the ring shaped groove 44 and the inner surface of the curved wall 39 of cylinder 14 is adjacent to one of the curved walls of the ring shaped groove and the outer surface of the curved wall 39 of the cylinder 14 is adjacent to the other curved wall of the ring shaped groove 44 so that the central portion of the trunk which remains is captured by the cylinder 14 and the Christmas tree is substantially stabilized on base 12 and the likelihood of the trunk splitting is reduced.

Some of the advantages of the embodiments of the above described invention are as follows.

1) Both the inner deeper ring cut and the outer shallower counter-bore may be made in a single operation.
2) The solid center core of wood in the trunk of the tree is the primary method of support for the tree on the stand.
3) The Christmas tree is not easily split since the adaptor holds the wood in place.
4) The adaptor can be recessed into the wood to prevent damage and to assure the stand will easily mount.
5) The adaptor can be inserted to any needed depth.
6) By inserting the adaptor deep enough into the trunk so that bark and an outer layer of wood extend below the lower edge of the adaptor, water is more easily absorbed into the tree.
7) With the adaptor being recessed into the tree, a fresh cut can be made on the tree without damage to the adaptor.
8) It is possible to use the drilled out portion of the trunk of the tree as a mounting hole for the stand without using the adaptor. In that case, the tree would be mounted directly on hollow upright tube 14.
9) The drill out methods set forth above can be used for applications other than for Christmas trees.
10) The adaptor may be made of most any rigid material, such as plastic or metal.
11) The adaptor allows for an unobstructed and dimensionally controlled fit to the tube extending from the bottom of the basin.
12) The adaptor holds the center core of the wood in the trunk of the tree in place to prevent splitting.
13) The adaptor is made to be attached to the basin by interference fit, snap fit, or screw, or other attachment.
14) The adaptor may be made to recess into or protrude from the trunk of the tree, depending on the application.
15) The basin and associated upright tube may be made of a material such as plastic or metal.
16) The basin and upright tube may be made to attach to the adaptor by interference fit, snap fit, or screw-on attachment.
17) The basin may also be made with the adaptor attached to it or built into it for insertion directly into a predrilled tree.
18) The basin is made to hold water.
19) The basin may also have legs mounted to it if needed for larger trees.

From the foregoing description of the preferred embodiments of the invention, it will be apparent that many modifications may be made therein. It should be understood, however, that each of these embodiments of the invention are exemplifications of the invention only and that the invention is not limited thereto. It is to be understood, therefore, that it is intended in the appended claims to cover all modifications as fall within the true spirit and scope of the invention.

The invention claimed is:

1. A combination of a Christmas tree and a Christmas tree stand comprising:

a Christmas tree having a trunk; the trunk having a bottom;

a shallower ring shaped groove forming at least two spaced apart curved walls in the bottom of the trunk wherein a shallower central portion of the trunk is defined by one of the curved walls of the shallower ring shaped groove;

a deeper ring shaped groove forming at least two spaced apart curved walls in the bottom of the trunk wherein a deeper central portion of the trunk is defined by one of the curved walls of the deeper ring shaped groove;

a base; the base having an inside surface facing the Christmas tree;

a male member extending upwardly from the inside surface of the base; an adapter removably attached to the male member; the adapter including a small hollow tube and a large hollow tube; the small hollow tube having a curved wall; the curved wall of the small hollow tube having an inner surface and an outer surface; at least a portion of the curved wall of the small hollow tube being received in the deeper ring shaped groove formed in the trunk of the Christmas tree; the large hollow tube having a curved wall; at least a portion of the curved wall of the large hollow tube being received in the shallower ring shaped groove formed in the trunk of the Christmas tree; whereby the inner surface of the curved wall of the small hollow tube is adjacent to one of the curved walls of the deeper ring shaped groove and the outer surface of the curved wall of the small hollow tube is adjacent to the other curved wall of the deeper ring shaped groove and the inner surface of the curved wall of the large hollow tube is adjacent to one of the curved walls of the shallower ring shaped groove and the outer surface of the curved wall of the large hollow tube is adjacent to the other curved wall of the shallower shaped groove so that the trunk is captured by the adapter and the Christmas tree is stabilized on the base and the likelihood of the trunk splitting is reduced.

2. A Christmas tree stand as set forth in claim 1 wherein the male member is integral with the base.

3. A Christmas tree stand as set forth in claim 1 wherein the base has at least one wall extending upwardly from the outer periphery of the inside surface of the base, thereby forming a basin for receiving water to hydrate the Christmas tree.

4. A Christmas tree stand as set forth in claim 1 wherein the large hollow tube has a diameter which is greater than the diameter of the small hollow tube; the large and small hollow tubes being rigidly attached to one another; the male member being in the form of a hollow cylinder having a curved wall; at least a portion of the inside surface of the large hollow tube and at least a portion of the outside surface of the small hollow tube juxtaposed to one another so as to form a space for receiving at least a portion of the curved wall the hollow cylinder.

* * * * *